United States Patent [19]

Nakatani et al.

[11] Patent Number: 5,054,441

[45] Date of Patent: Oct. 8, 1991

[54] DECOMPRESSION DEVICE IN A TWO-CYCLE ENGINE

[75] Inventors: Yoshihide Nakatani; Shigeichi Okada; Eiji Yaezawa; Makoto Takata; Takafumi Nakahara, all of Nagoya, Japan

[73] Assignee: Mitsubishi Jukogyo Kabushiki Kaisha, Tokyo, Japan

[21] Appl. No.: 353,322

[22] Filed: May 15, 1989

[30] Foreign Application Priority Data

Jun. 17, 1988 [JP] Japan ..... 63-79519[U]
Jun. 27, 1988 [JP] Japan ..... 63-83989[U]

[51] Int. Cl.[5] ..... F02N 17/00
[52] U.S. Cl. ..... 123/182; 123/65 P
[58] Field of Search ..... 123/182, 65 P

[56] References Cited

U.S. PATENT DOCUMENTS

| | | | |
|---|---|---|---|
| 2,985,157 | 5/1961 | Venediger | 123/41.7 |
| 3,417,740 | 12/1968 | Perlewitz | 123/182 |
| 3,774,303 | 11/1973 | Burkett et al. | 123/182 |
| 4,312,308 | 1/1982 | Slattery | 123/182 |

FOREIGN PATENT DOCUMENTS

| | | | |
|---|---|---|---|
| 2525687 | 10/1983 | France . | |
| 56-11623 | 3/1981 | Japan . | |
| 57-113963 | 7/1982 | Japan . | |
| 58-27076 | 6/1983 | Japan . | |
| 64-1470 | 1/1989 | Japan . | |
| 525823 | 9/1940 | United Kingdom | 123/65 P |
| 1386177 | 3/1975 | United Kingdom . | |

*Primary Examiner*—Andrew M. Dolinar
*Attorney, Agent, or Firm*—Wenderoth, Lind & Ponack

[57] ABSTRACT

For the purpose of preventing a decompression passageway in a two-cycle engine from being blocked by carbon soot, facilitating manufacture of a two-cycle engine having decompression structure and eliminating reduction of output power of the two-cycle engine caused by the decompression structure, a known two-cycle engine includes a scavenging passageway formed along an inner wall of a cylinder. The scavenging passageway is directed in the axial direction of the cylinder and communicates with a crank case of the engine. A decompression groove extends in the axial direction of the cylinder on the upstream side of a cylinder cooling airflow at a top end portion of the scavenging passageway. The width and depth of the decompression groove are either varied along the axial direction of the groove so as to be narrowed towards a tip end thereof directed toward a plug, or are provided with a narrowed portion of venturi shape.

7 Claims, 3 Drawing Sheets

DECOMPRESSION DEVICE IN A TWO-CYCLE ENGINE

BACKGROUND OF THE INVENTION

1. Field of the Invention

The present invention relates to a decompression device in a two-cycle engine which can reduce a starting torque upon start of the engine.

2. Description of the Prior Art

One prior art example of a two-cycle engine having decompression means is illustrated in FIG. 7. The illustrated engine is a piston valve type spark-ignition two-cycle engine. In this figure, reference numeral 1 designates a cylinder, numeral 2 designates a cylinder liner forming an inner wall of the cylinder 1, numeral 3 designates a piston, numeral 4 designates a cylinder head, numeral 5 designates a combustion chamber, numeral 6 designates an exhaust port, and an opening 6*a* of the exhaust port 6 on the side of the cylinder inner wall is opened and closed by sliding movements of the piston 3.

On the inner wall of the above-mentioned cylinder 1 is scooped out or formed a compressed gas leak groove 7 located within the range of and adapted to be opened and closed by sliding movements of the piston 3. Groove 7 extends from the top edge of the opening 6*a* of the exhaust port 6 on the side of the cylinder inner wall towards the upper dead point as shown in FIG. 8.

This compressed gas leak groove 7 is formed in an inverse isosceles trapezoid shape in a plan configuration having a portion 7*a* communicating with the opening 6*a* of the exhaust port on the side of the cylinder inner wall side choked into a narrow width as compared to its top starting edge portion 7*b*, as shown in FIG. 9.

It is to be noted that examples of modifications of the above-described compressed gas leak groove 7 of inverse isosceles trapezoid shape are a compressed gas leak groove 8 of oval shape in plan configuration as shown in FIG. 10, a compressed gas leak groove 9 of T-shape as shown in FIG. 11, a compressed gas leak groove 10 of inclined key hole shape as shown in FIG. 12, and a compressed gas leak groove 11 of X-mas tree shape as shown in FIG. 13. End portions 8*a*, 9*a*, 10*a* and 11*a* of such grooves communicating with the opening 6*a* of the exhaust port 6 on the side of the inner wall of the cylinder are formed to be narrow in width.

Also, in some cases, there may be provided plural of the above-mentioned compressed gas leak grooves 7–11 distributed along the opening 6*a* of the exhaust port 6 on the side of the inner wall of the cylinder. Furthermore, the top starting end portion of each of the above-described compressed gas leak grooves 7–11 is disposed preferably at a position of 40° or less in a crank shaft angle.

Still further, preferably the above-mentioned compressed gas leak groove 7 (or 8–11) is formed in such manner that the depth of the groove at the top starting end portion 7*b* is relatively shallow, but that the depth at the communicating portion 7*a* is deep, resulting in an advantage that flow of the exhaust gas passing through the compressed gas leak groove 7 is made smooth. It is to be noted that reference numeral 13 designates an air feed port.

In the above-described prior art decompression device in a two-cycle engine, the decompression passageway (compressed gas leak groove) 7 communicates with the exhaust port 6 and the combustion chamber 5.

Accordingly, an incomplete combustion gas that is inherent to a two-cycle engine will pass through the decompression passageway 7 and will escape through the exhaust port 6. At this time, carbon soot is liable to block the decompression passageway 7, and thus the function of the passageway is deteriorated.

Furthermore, regarding the process for manufacturing the engine, in order to provide the groove 7 in the prior art, an inner mold of a cylinder would be withdrawn in a direction opposite to a plug. Accordingly, at first a mold for forming the groove 7 must be moved to a central portion, and in the subsequent step of the process the inner mold must be withdrawn downwards, so that man-hours required for the manufacturing operation is increased.

In addition, if the groove is provided in the above-described manner, there is a disadvantage that reduction of output power results due to lowering of a compression pressure of the engine and due to leakage of gas through an escape groove upon an expansion stroke after ignition.

SUMMARY OF THE INVENTION

It is therefore one object of the present invention to provide an improved decompression device in a two-cycle engine, in which blocking of a decompression passageway by carbon soot can be avoided, the process for manufacturing the engine is facilitated, and reduction of output power caused by decompression means can be eliminated.

According to one feature of the present invention, there is provided a decompression device in a two-cycle engine, in which there are provided a scavenging passageway formed along an inner wall of a cylinder and directed in the axial direction thereof and communicating with a crank case, a decompression groove extending in the axial direction of the cylinder on the upstream side of a cylinder cooling airflow at a top end portion of the scavenging passageway. The width and depth of the decompression groove are varied along the axial direction of the groove so as to be narrowed towards its tip end directed toward a plug of the engine.

More particularly, according to the present invention, the decompression groove for enabling a gaseous fuel air mixture within a cylinder chamber to escape into a crank case upon starting of an engine, is formed at the top end portion of the scavenging passageway and is directed in the axial direction. Furthermore, in order that the decompression groove hardly may be blocked by carbon soot, the decompression groove is provided in the scavenging passageway on the upstream side of the cylinder cooling airflow.

On the other hand, the shape of the decompression groove is such as to make blockage difficult, and a narrowed portion of venturi shape is provided in one part of the decompression groove.

In operation, since the decompression groove communicates with the crank case via the scavenging passageway, when a piston moves from the upper dead point to the lower dead point, combustion gas passes through the decompression groove and enters the crank case. However, since fresh air again enters the cylinder from the crank case through the scavenging passageway and the decompression groove, the decompression groove is hardly blocked by carbon soot.

The decompression groove also can be formed by prior art processes, and thus an increase in cost due to construction of additional molds can be prevented.

Since the temperature and pressure of the gas in the expansion stroke upon operation are high, when the gas leaks through an escape groove, the gas flow velocity reaches the velocity of sound. However, the gas flow is dammed by the venturi in the groove, and hence leakage of the gas is reduced and reduction of output power can be prevented.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1:
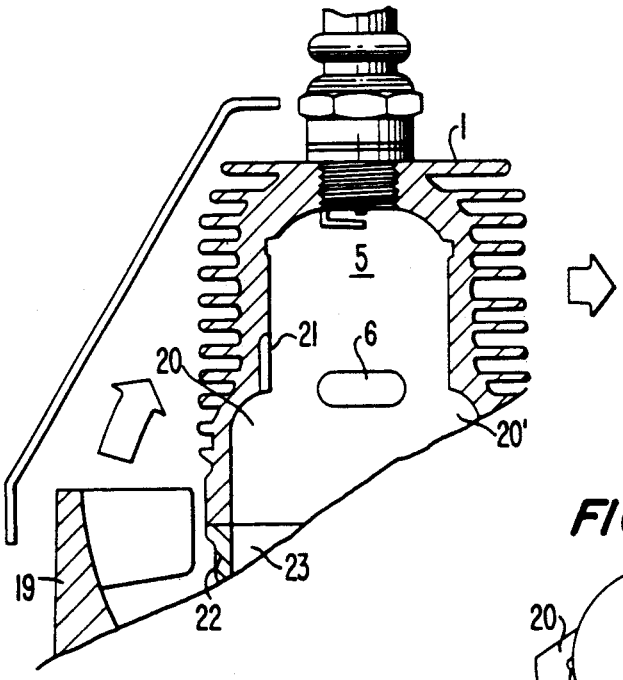
FIG. 1(A) is a longitudinal cross-sectional view showing one preferred embodiment of the present invention.
FIG. 1(B) is a general cross-sectional view of a cylinder in the structure shown in FIG. 1(A)
FIG. 1(C) is a schematic transverse cross-sectional view taken along line 1(C)–1(C) in FIG. 1(B) as viewed in the direction of the arrows.
Figure 1:
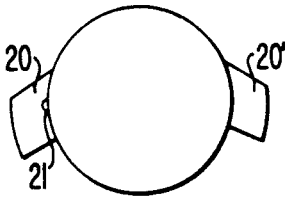
Figure 1:
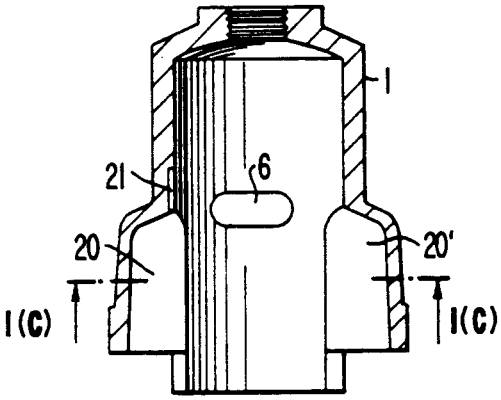
Figure 2:
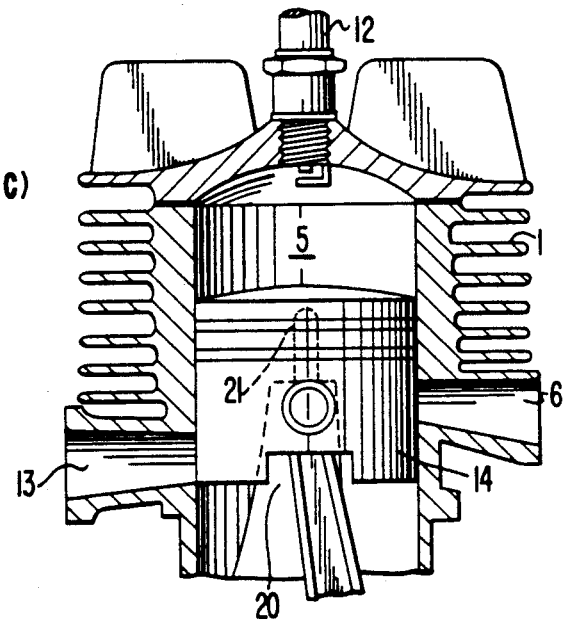
FIG. 2 is a longitudinal cross-sectional view of a scavenging passageway and its adjacent vicinity including a piston.

Referring now to FIGS. 1(A)–2, a two-cycle engine having a decompression device according to the present invention is shown in longitudinal cross-section taken along a scavenging passageway in a cylinder 1. Reference numeral 19 designates a fan for cooling the cylinder 1, and a cooling airflow is made to flow by fan 19 as show by bold white arrows. Reference numerals 20 and 20′ designate scavenging passageways of the cylinder 1, each of which communicates a crank case 23 with a combustion chamber 5. Reference numeral 6 designates an exhaust port, and reference numeral 13 designates an intake or suction port.

At the top end portion of the scavenging passageway 20 on the upstream side of the cooling airflow, is provided a decompression groove 21 for returning a fuel-gas mixture into the crank case 23 and directed in the axial direction of the cylinder 1. The top end of this decompression groove 21 is positioned at such location that before the suction port 13 is opened by a piston 14 it does not communicate with the combustion chamber 5 (FIG. 2).

Figure 3:
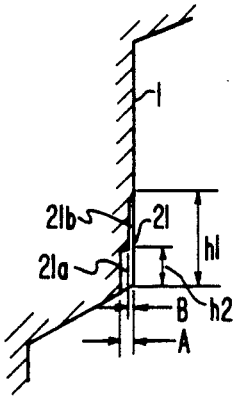
FIGS. 3(A) and 3(B) are a cross-sectional view and a side view, respectively, of one form of decompression groove.
Figure 3:
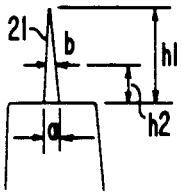

FIGS. 3(A)–(B) are detailed illustrations of the configuration of the decompression groove.

Figure 4:
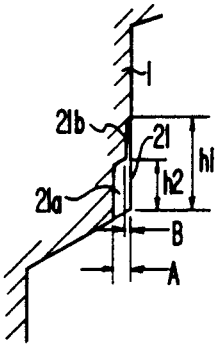
FIGS. 4(A) and 4(B) are a cross-sectional view and a side view, respectively, of a different form of decompression groove.
Figure 4:
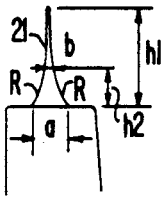
Figure 5:
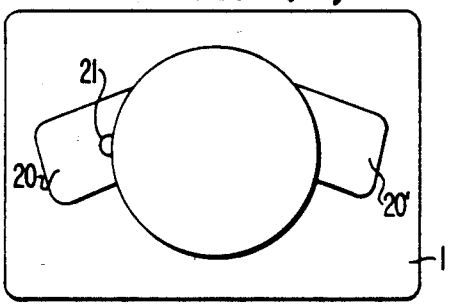

FIGS. 3(A) and 3(B) show a triangular shape sharpened towards a plug of the cylinder. FIGS. 4(A) and 4(B) show a flared shaped, with curved sides R, broadened towards the scavenging passageway. As shown in FIGS. 3(A) and 4(A), each groove has a lower portion 21*a* of greater depth A and an upper portion 21*b* of lesser depth B. As shown in FIGS. 3(B) and 4(B), the width a of the base of each portion 21*a* is greater than the width b of the base of each portion 21*b*. Also, the axial length h2 of portion 21*a* is less than the total axial length h1 of groove 21. Further, the width a of portion 21*a* is less than the width of passageway 20. Yet further, it is preferable that the dimensional relationships of $h_2 \leqq h_1/2$, $B \leqq A/2$ and $b \leqq a/2$ are fulfilled.

Figure 5:
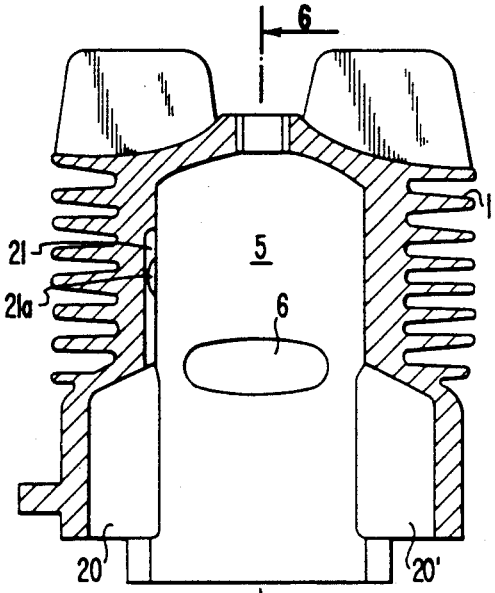
FIG. 5(A) is a longitudinal cross-sectional view showing another preferred embodiment of the present invention.
FIG. 5(B) is a bottom view of the structure shown in FIG. 5(A)
Figure 6:
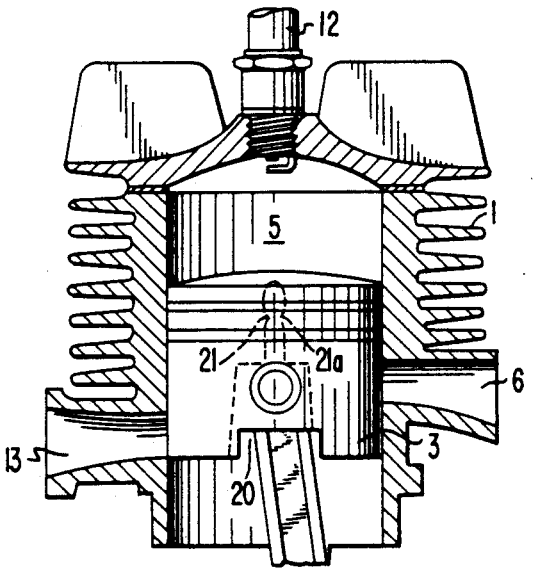
FIG. 6 is another longitudinal cross-sectional view of the structure shown in FIG. 5(A) taken along line 6—6 in FIG. 5(A) as viewed in the direction of the arrows.
Figure 7:
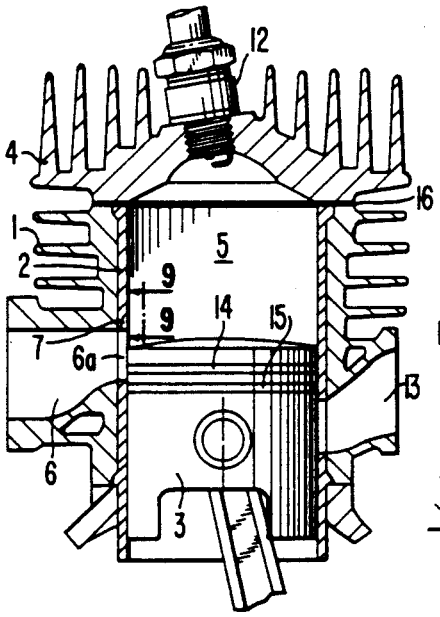
FIG. 7 (PRIOR ART)
FIG. 7 is a longitudinal cross-sectional view of a two-cycle engine having decompression means in the prior art.
Figure 8:
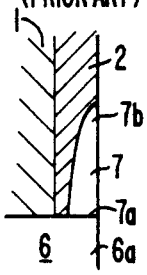
FIG. 8 (PRIOR ART)
FIG. 8 is an enlarged partial cross-sectional view of a compressed gas leak groove in FIG. 7.
Figure 9:
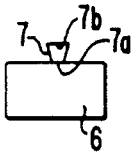
FIG. 9 (PRIOR ART)
FIGS. 9 through 13 are enlarged partial cross-section views of different compressed gas leak grooves in the prior art taken along line 9—9 in FIG. 7 as viewed in the direction of the arrows.
Figure 10:
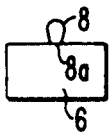
FIG. 10 (PRIOR ART)
Figure 11:
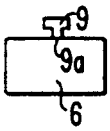
FIG. 11 (PRIOR ART)
Figure 12:
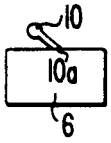
FIG. 12 (PRIOR ART)
Figure 13:
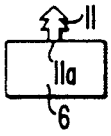
FIG. 13 (PRIOR ART)

In addition, FIGS. 5(A) and 5(B) show a cylinder of a two-cycle engine according to another preferred embodiment of the present invention, FIG. 6 shows the state where the same cylinder 1 is assembled in an engine, and in these figures reference numeral 21 designates an escape groove, and numeral 21*a* designates a venturi shaped narrowed portion.

Owing to the existence of the escape groove 21, in the case of a low rotational speed such as upon starting, a compressed fuel-air mixture will escape. Hence, an operating load of a recoil starter or the like for use in starting is light, and the starter can be operated easily. On the other hand, upon regular operation, since the gas within the cylinder becomes high-temperature and high-pressure, upon passing through the escape groove the gas velocity becomes equal to the velocity of sound, in this case according to the generally well-known theory, it becomes difficult for the gas to flow due to the venturi portion. Hence, leakage will be reduced, and accordingly, reduction of output power is slight.

As will be apparent from the detailed description above, according to the present invention, the following effects and advantages are obtained:

1) Owing to the fact that a decompression groove directed in the axial direction is provided at the top end portion of a scavenging passageway within a cylinder chamber communicating with a crank case, a fuel-air mixture within the cylinder chamber returns to the crank case through the decompression groove. Thus, the starting torque required upon starting of an engine can be reduced.
2) As a result of the fact that a decompression groove is provided on the side of the scavenging passageway on the upstream side of a cylinder cooling airflow, the temperature at the vicinity of the decompression groove can be lowered, and this serves to prevent accumulation of carbon soot in the decompression groove.
3) Even if a combustion gas should pass through the r′ decompression groove, since fresh air would flow into the combustion chamber from the crank case through the scavenging passageway, the decompression groove would not be blocked by carbon soot.
4) Owing to the fact that the width and depth of the groove are varied along the axial direction of the groove so as to be narrowed at the tip end thereof directed towards the plug, the velocity of flow of the fuel-air mixture flowing through the decompression groove will vary, and hardly any carbon soot will be deposited. In addition, control for lowering of output power and reduction of starting torque will be possible.

5) Since the decompression groove is formed at the top end portion of the scavenging passageway, the inner configuration of the cylinder chamber can be formed in one step of a manufacturing process, and thus the cost of manufacture will not be increased.

6) Upon normal operation, a high-velocity gas flow is limited by the narrowed portion of the venturi, hence leakage is reduced, and reduction of output power will be slight.

While a principle of the present invention has been described above in connection with preferred embodiments of the invention, it is a matter of course that many apparently widely different embodiments of the present invention can be made without departing from the spirit of the invention.

What is claimed is:

1. A decompression arrangement in a two-cycle engine including a cylinder having an inner wall, a compression chamber, a crankcase, and means forming a cylinder cooling airflow, said decompression arrangement comprising:

a scavenging passageway formed in said cylinder inner wall and extending axially of said cylinder;

a decompression groove formed in said cylinder wall and extending axially of said cylinder at a position communicating with an end of said scavenging passageway directed toward said compression chamber and to be on an upstream side of the cylinder cooling airflow;

said decompression groove including a first portion with a base end communicating with said end of said scavenging passageway and an opposite end directed toward said combustion chamber and a second portion with a base end communicating with said opposite end of said first portion and an opposite end directed toward said combustion chamber;

said first portion having a depth greater than the depth of said second portion;

said base end of said first portion having a width less than the width of said end of said scavenging passageway, and said base end of said second portion having a width less than said width of said base end of said first portion; and said first portion having an axial length less than the total axial length of said decompression groove.

2. An arrangement as claimed in claim 1, wherein said depth of said second portion is less than or equal to half said depth of said first portion.

3. An arrangement as claimed in claim 1, wherein said width of said base end of said second portion is less than or equal to half said width of said base end of said first portion.

4. An arrangement as claimed in claim 1, wherein said axial length of said first portion is equal to or less than half said axial length of said decompression groove.

5. An arrangement as claimed in claim 1, wherein the width of said decompression groove continuously decreases from said base end of said first portion to said opposite end of said second portion.

6. An arrangement as claimed in claim 5, wherein said decompression groove is of triangular shape.

7. An arrangement as claimed in claim 5, wherein said decompression groove is defined by curved flared sides extending from said base end of said first portion.

* * * * *